US006086011A

United States Patent [19]

Shibazaki et al.

[11] Patent Number: 6,086,011

[45] Date of Patent: Jul. 11, 2000

[54] AUTOMATIC BAND CHARGING DEVICE FOR STRAPPING PACKING MACHINE

[75] Inventors: Tokio Shibazaki; Shigeo Kobayashi; Osatomi Kawai, all of Kawasaki, Japan

[73] Assignee: Strapack Corporation, Japan

[21] Appl. No.: 09/229,708

[22] Filed: Jan. 13, 1999

[30] Foreign Application Priority Data

Jan. 13, 1998 [JP] Japan ..... 10-004601

[51] Int. Cl.[7] ..... B65H 19/00

[52] U.S. Cl. ..... 242/560; 242/560.1; 242/562.1; 242/563; 242/564.4; 242/566; 226/176; 226/182

[58] Field of Search ..... 242/560, 560.1, 242/563, 564.4, 566, 562.1; 226/176, 177, 181, 182, 191, 194

[56] References Cited

U.S. PATENT DOCUMENTS

| | | | |
|---|---|---|---|
| 3,622,097 | 11/1971 | Maas | 242/562.1 X |
| 4,763,823 | 8/1988 | Eder et al. | 242/560.1 X |
| 4,770,366 | 9/1988 | Hood et al. | 242/560 X |
| 4,872,939 | 10/1989 | McVay et al. | 242/560.1 X |
| 4,984,750 | 1/1991 | Shigeta et al. | 242/562.1 X |
| 5,101,701 | 4/1992 | Boldrini et al. | 242/564.4 X |
| 5,244,161 | 9/1993 | Wirtz-Odenthal | 242/560.1 |
| 5,275,673 | 1/1994 | Suzuki et al. | 242/562.1 X |
| 5,297,751 | 3/1994 | Boldrini et al. | 242/560.1 |
| 5,299,407 | 4/1994 | Shuttler et al. . | |
| 5,330,119 | 7/1994 | Rodriguez et al. | 242/560.1 X |

FOREIGN PATENT DOCUMENTS

| | | | |
|---|---|---|---|
| 453943 | 10/1991 | European Pat. Off. | 226/181 |
| 0544066 | 6/1993 | European Pat. Off. . | |
| 5-86803 | 11/1993 | Japan . | |
| 6-69105 | 9/1994 | Japan . | |

*Primary Examiner*—Donald P. Walsh
*Assistant Examiner*—Minh-Chau Pham
*Attorney, Agent, or Firm*—Webb Ziesenheim Logsdon Orkin & Hanson, P.C.

[57] ABSTRACT

Front end portions of respective bands drawn out of two band reels are guided in substantially parallel relationship by means of band guide 11. When the band reel in use becomes empty, band feeding unit 30 is driven in reverse to thereby discharge a rear end portion of the band and, further, a front end portion of other band in stand-by condition is moved to a position of use by means of band changeover unit 20. An automatic band charging device can be provided which enables rapidly replacing an empty band reel with a spare band reel and which has a simple structure and realizes a reduced number of constituent parts, thereby contributing to the miniaturization of the packing machine.

2 Claims, 10 Drawing Sheets

AUTOMATIC BAND CHARGING DEVICE FOR STRAPPING PACKING MACHINE

FIELD OF THE INVENTION

The present invention relates to an automatic band changing device for a strapping packing machine. More particularly, the present invention relates to an automatic band changing device for use in a strapping packing machine, which enables rapidly conducting replacement between two band reels.

BACKGROUND OF THE INVENTION

Full automatic strapping packing machines are employed in workshops wherein a large number of items must be strapped within a given period of time, for example, newspaper shipping sites.

Even in the use of such full automatic strapping packing machines, the band reels must be replaced when they become empty. This replacement is generally conducted by manual work, so that the workload has caused a lowering of packing efficiency.

Thus, in recent years, strapping packing machines equipped with a spare band reel have been proposed, which include, for example, packing machine proposed by the applicant, disclosed in Japanese Utility Model Registration Application No. 6(1994)-69105 and shown in FIG. 10.

Referring to FIG. 10, the strapping packing machine is equipped with two band reels 51,52. When one of them becomes empty, guide means 53 is horizontally slid to thereby enable feeding of a band from the other band reel.

Although this strapping packing machine enables rapidly replacing a band reel with a spare band reel, the strapping packing machine must be equipped with two guide rollers 55,56 and two band feeding means 57,58. As a result, the number of parts constituting the strapping packing machine is increased, and, further, a space for permitting the sliding of the guide means 53 must be provided.

The present invention overcomes the shortcomings of the prior art by providing an automatic band changing device for use in a strapping packing machine, which enables rapidly replacing an empty band reel with a spare band reel and which has a simple structure and realizes a decreased number of constituent parts to thereby contribute to miniaturization of the strapping packing machine.

SUMMARY OF THE INVENTION

The present invention, provides an automatic band changing device for a strapping packing machine, comprising:

- a band guide for guiding front end portions of respective bands drawn out from two band reels in substantially parallel relationship,
- a cylindrical guide roller for feeding a band from a band changing port to the band guide,
- a sensor arranged so as to face the band guide and capable of detecting a rear end portion of band in use,
- two pin cylinder units capable of actuating a pin for holding down the rear end portion of band in use in accordance with a detection signal from the sensor and a pin for releasing a front end portion of band having been held down and not in use,
- a band feeding unit composed of a forward and backward rotatable pool feed roller and a touch roller fitted with an eccentric shaft, these arranged opposite to each other so as to have a traveling passage of the band guide interposed therebetween,

- a cylinder unit fitted to the touch roller and capable of bringing the touch roller into contact with the forward rotating pool feed roller or parting the touch roller from the forward rotating pool feed roller, and
- a band changeover lever arranged beside the band guide and capable of moving a front end portion of stand-by band to a band passage of the band guide when one of the band reels becomes empty.

With the use of the above constituted automatic band changing device for a strapping packing machine, the feeding of the band can be conducted by pressing the touch roller against the forward and backward rotatable pool feed roller of the band feeding unit. Furthermore, the feeding of the band can be discontinued by parting the touch roller from the forward and backward rotatable pool feed roller. When the sensor has detected the emptiness of the band reel, a rear end portion of band can be discharged by actuating the pin cylinder unit to thereby compulsorily stop the run of the band and, thereafter, reversing the pool feed roller. Furthermore, a spare band can be automatically set by means of subsequently actuated changeover lever.

DETAILED DESCRIPTION OF THE INVENTION

Figure 1:
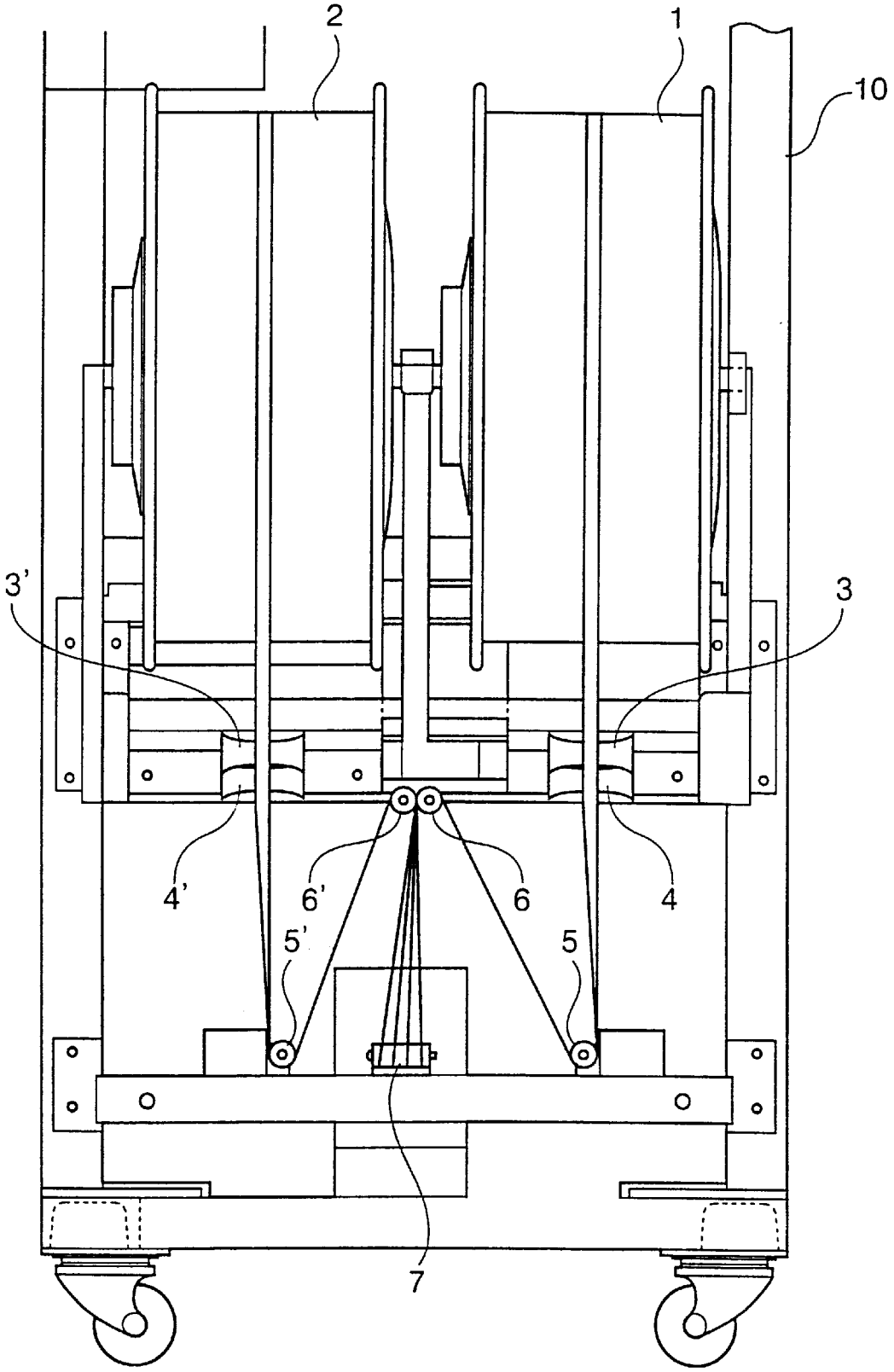
FIG. 1 is a side view of a strapping packing machine equipped with a band changing device according to one embodiment of the present invention.
Figure 2:
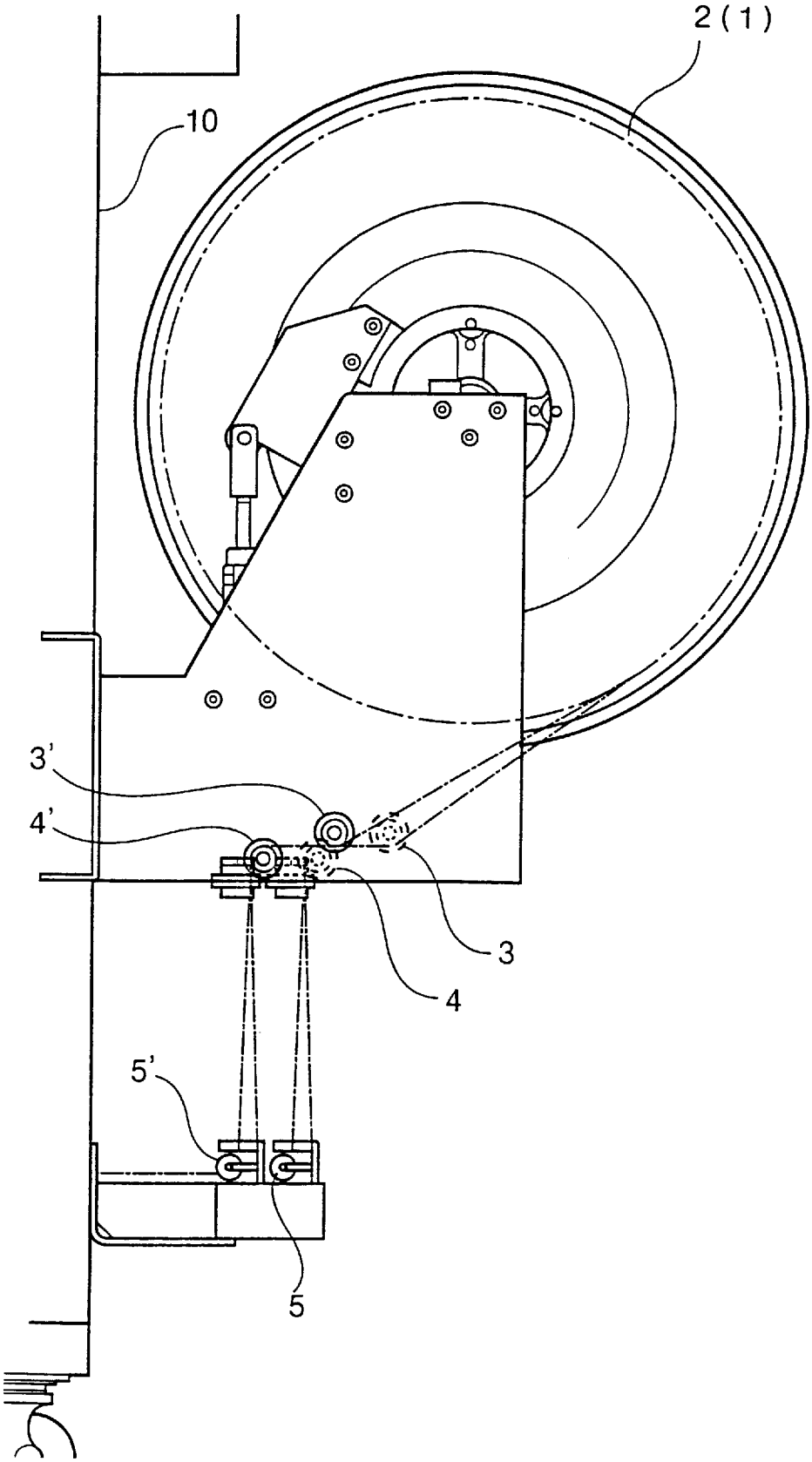
FIG. 2 is a front view of the strapping packing machine shown in FIG. 1.

The present invention will be described below with reference to the following embodiment shown in the drawings.

FIGS. 1 to 9 show a strapping packing machine provided with an automatic band changing device according to one embodiment of the present invention. This strapping packing machine is equipped with two band reels 1,2 having a large volume of band wound thereon, arranged side by side in the direction of the width thereof at a side of packing machine frame 10. The arrangement is so made that, when first band reel 1 is empty of band, the strapping with the use of the first band reel 1 is immediately followed by the strapping with the use of the other band reel 2 arranged in waiting condition.

For the setting in use condition of the front end portion of the band from the band reel 1,2, band passing is generally conducted prior to the operation of the strapping packing machine. The first employed band reel is not limited and may be band reel 1 or band reel 2. Supposing that the band reel 1 is first used, the front end portion of the band is passed through the gap between guide rollers 3,4 (guide rollers 3',4' when the band reel 2 is first used). The passed band is twisted by 90° and passed on band end detecting roller 5 (or band end detecting roller 5'). Although not shown, the band end detecting roller 5,5' is fitted with a phototube sensor which is capable of detecting the passage of the rear end portion of the band fed from the band reel 1,2 to thereby find that there is no band on the band reel 1,2. Further, the band is passed on guide roller 6 (or guide roller 6'), twisted by 90° so that the inside of the band in a wound state comes downward and passed on guide roller 7.

Figure 5:
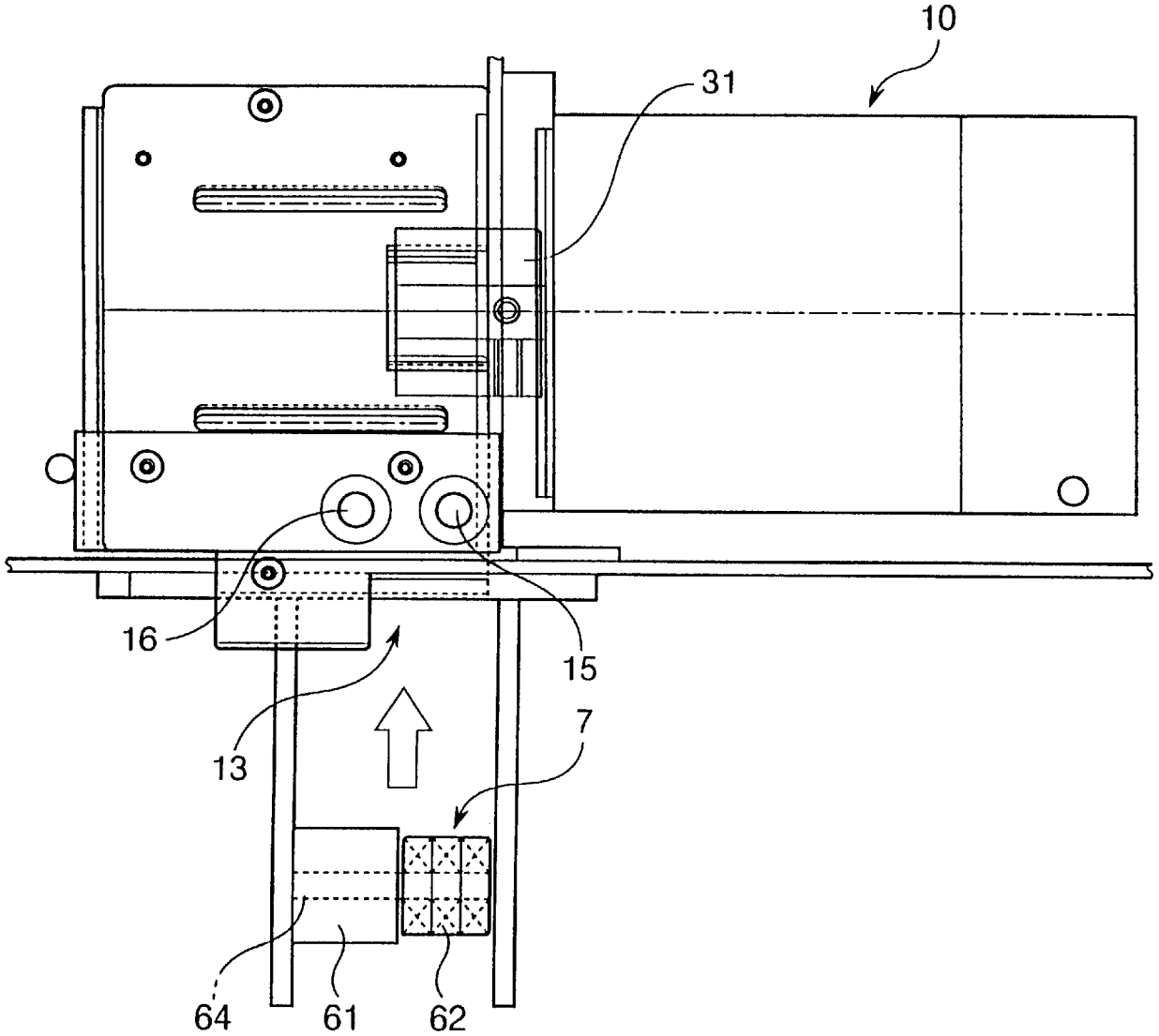
FIG. 5 is a plan view of the vicinity of band changing port shown in FIG. 3.
Figure 6:
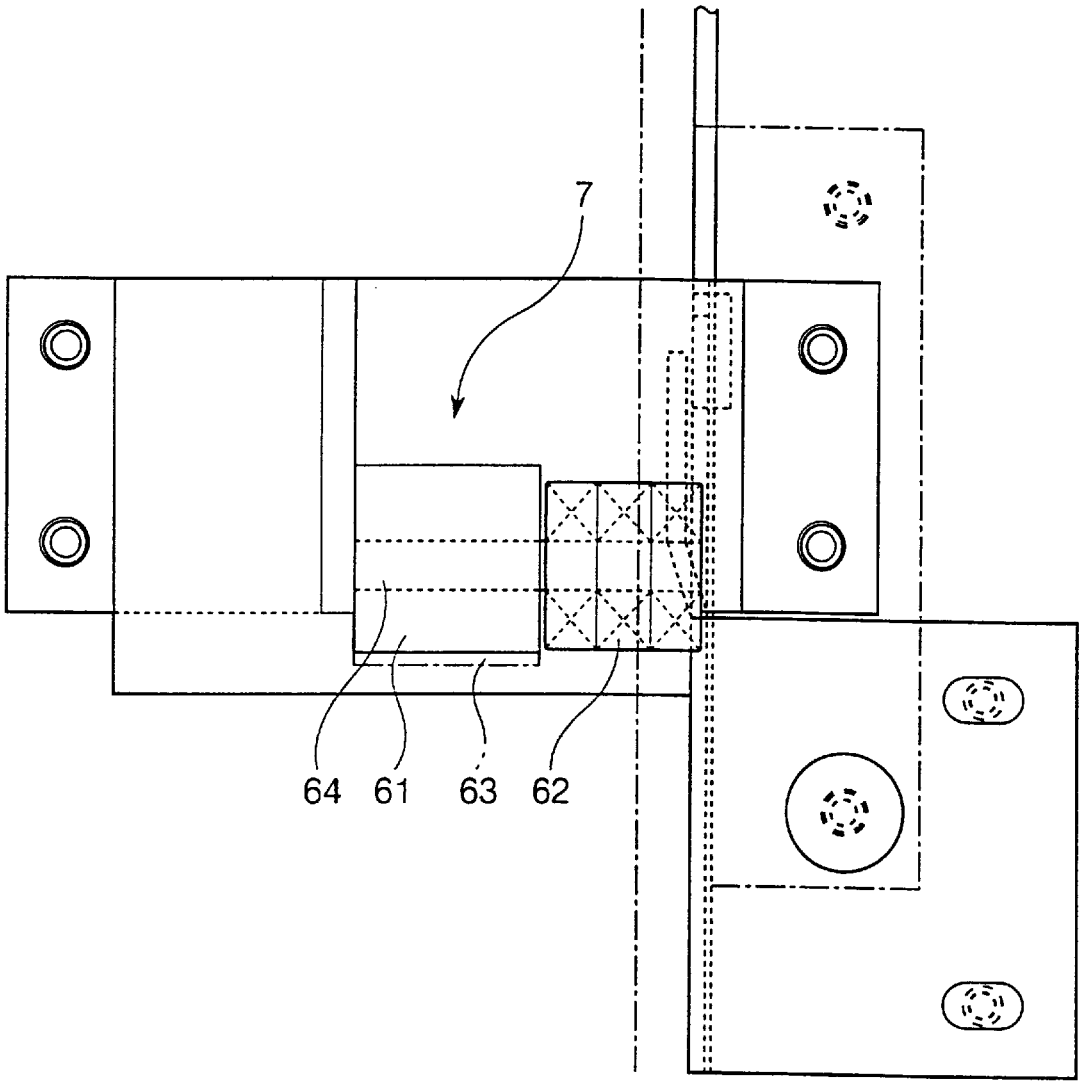
FIG. 6 is a side view of the band changing port vicinity of FIG. 5.
Figure 7:
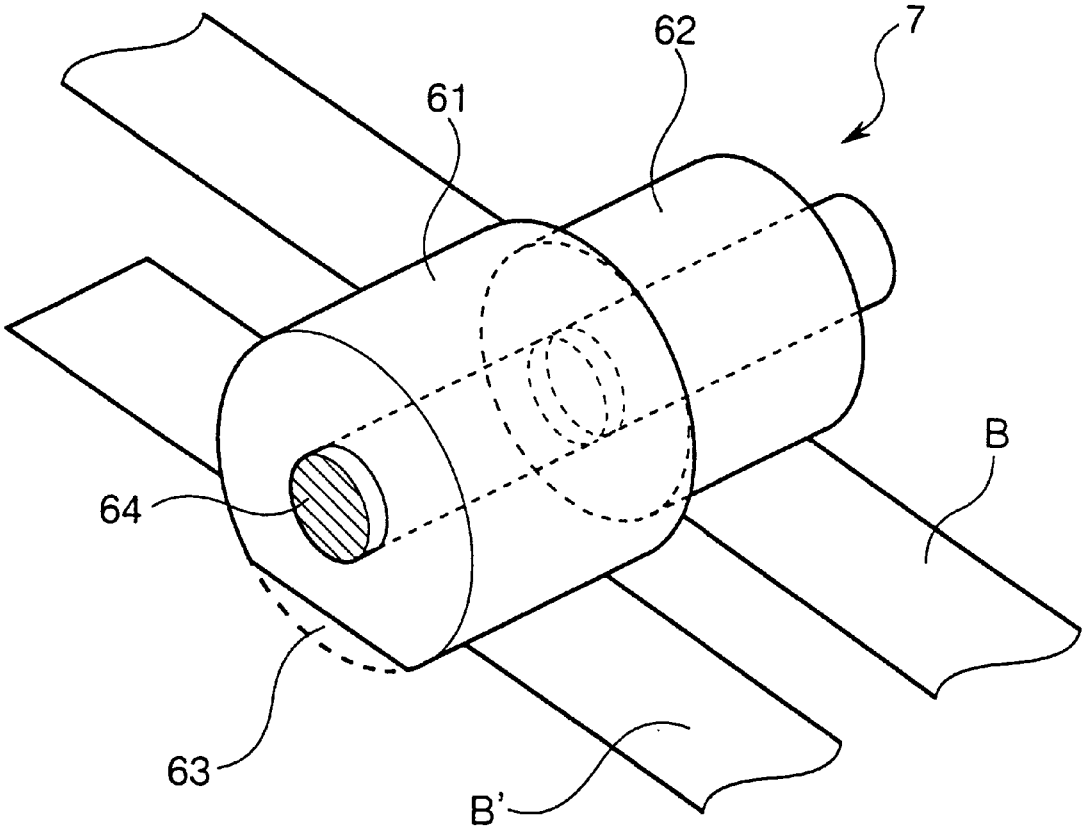
FIG. 7 is a perspective view of a guide roller employed in one embodiment of the present invention.

Referring to FIGS. 5 to 7, although the guide roller 7 is formed in cylindrical form, the guide roller 7 is partitioned into band setting part 61 on which stand-by band is passed and band using part 62 on which the band in use is passed. Cutout 63 is formed at a lower surface of the band setting part 61. Although the band setting part 61 and the band using part 62 are provided coaxially, the band setting part 61 cannot be rotated and fixed to shaft 64 while the band using part 62 can be rotated on a bearing. Further, there is a level difference between the band setting part 61 and the band using part 62, so that the band in use B fed on the peripheral surface of the band using part 62 does not move toward the band setting part 61.

In the above guide roller 7, the band in use B is passed on the lower surface of the band using part 62, and the stand-by band B' is passed on the lower surface of the band setting part 61.

Upon the passing of the two bands on the guide roller 7 in the above manner, the front end portions of the two bands are guided into band changing port 13 disposed at a side of the packing machine frame 10, as indicated by the arrow in FIG. 5.

The detailed explanation of the band changing device disposed in the band changing port 13 will be described as follows.

Figure 3:
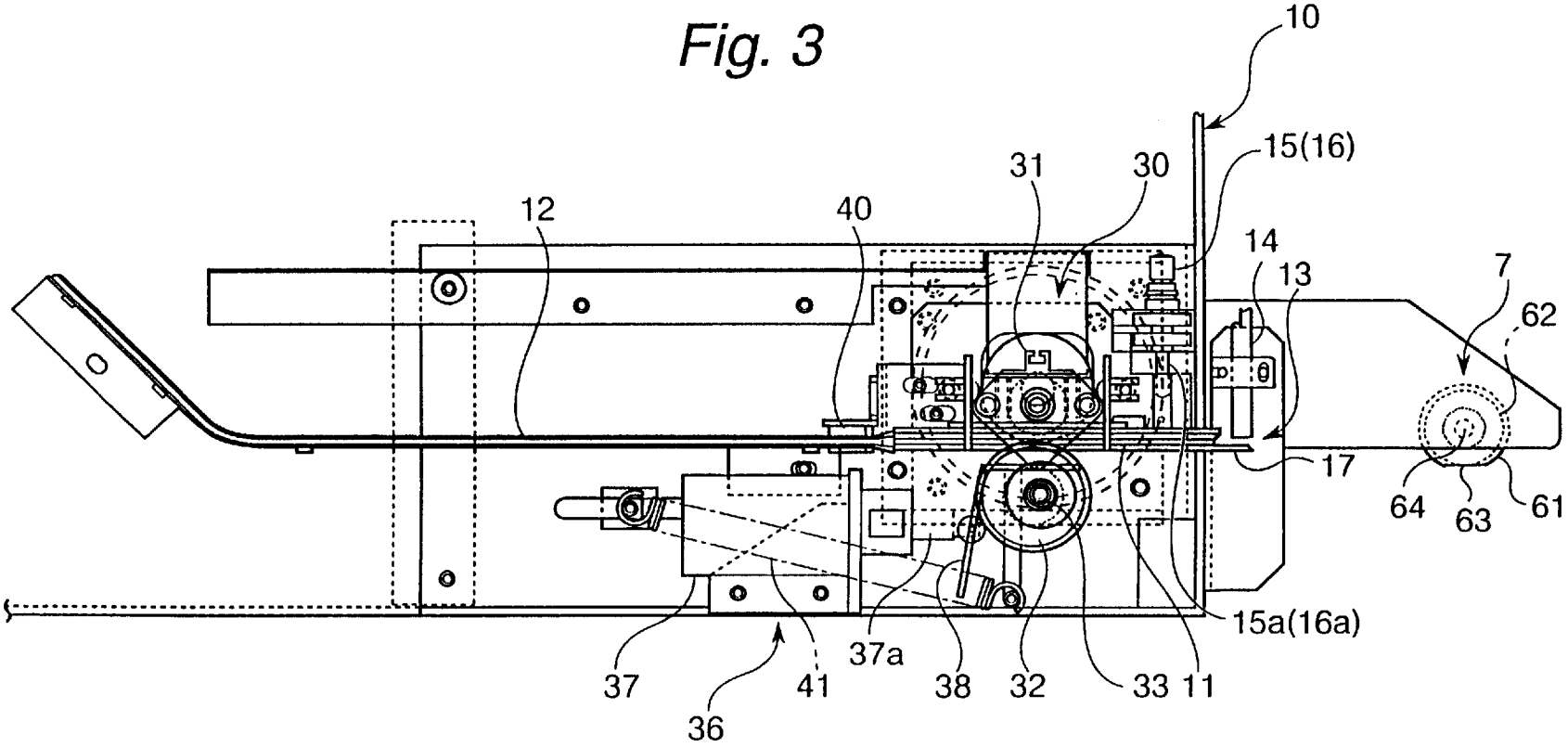
FIG. 3 is a sectional view of essential parts of a band changing device according to one embodiment of the present invention.

Referring now to FIG. 3, band guide 11 providing a band passage is disposed in the packing machine frame 10. This band guide 11 at its downstream portion is connected in communicating relationship to pool shooter 12. A pool box for storing the band in an amount required for some cycles of strapping is arranged downstream of the pool shooter 12. From this pool box, the band is fed to a packed item side in an amount required for each cycle of strapping.

The band guide 11 at its vicinity of the band changing port 13 has a width increased so that the front end portions of the two bands can be inserted therein side by side. On the other hand, the band guide 11 at its downstream portion, i.e., at its side of the pool shooter 12 has a width decreased so that only one band in use can pass therethrough.

Further, the band guide 11 linearly connected in communicating relationship to the pool shooter 12 at its vicinity of the band changing port 13 is fitted with protrudent band receiver 17 for facilitating the passing of the band.

Phototube 14 as a sensor is arranged above the band receiver 17, which phototube 14, when the band is discharged from the machine by a reversion, detects the discharge of the band.

On the other hand, pin cylinders 15,16 having respective pins 15*a*,16*a* are arranged side by side slightly inward from the phototube 14. These pins 15*a*, 16*a* are extended or contracted upon the input of a given signal in the control unit. A passage for the band B in use is provided just under the pin cylinder 15. On the other hand, a passage for the stand-by band B' is provided just under the pin cylinder 16. In the regular use condition, namely, when the first band is being used, the pin 15*a* of the pin cylinder 15 is positioned upward and is detached from the band B in use. In this condition, the pin 16*a* of the pin cylinder 16 is, contrarily, positioned downward and holds the stand-by band B' down. At the time of band exchange, the pin 15*a* of the pin cylinder 15 is moved downward and, simultaneously, the pin 16*a* of the pin cylinder 16 is moved upward.

Limit switch 40 is disposed downstream of the band guide 11. The limit switch 40 detects the arrival of the front end of the band B when the first employed band B is set in usable condition. Owing to the disposition of the limit switch 40, when the front end of the band B is detected by the limit switch 40 in the passing of the first employed band B, the pin cylinder 16 is immediately actuated so that the pin 16*a* is moved downward to thereby once hold the band B down.

When resetting is effected by unlocking a stop button, the pin cylinder 16 is moved upward so that the band B is pressed by tilting piece 24 to position under pool feed roller 31. Thereafter, an automatic changing is executed.

When band B runs out during the use of the band B and the rear end portion of the band B passes under the band end detecting roller 5, the phototube sensor assembled in the band end detecting roller 5 detects this and generates signal. Upon receiving the detection signal, the pin 15*a* of the pin cylinder 15 extends downward to thereby again hold the band B in use down.

Synchronously therewith, the pin cylinder 16 which has held the front end of the stand-by band B' down is actuated so that the pin 16*a* is moved upward. Thus, the band B' having been held down is released.

Band changeover unit 20 is disposed beside the pin cylinders 15,16.

Figure 4:
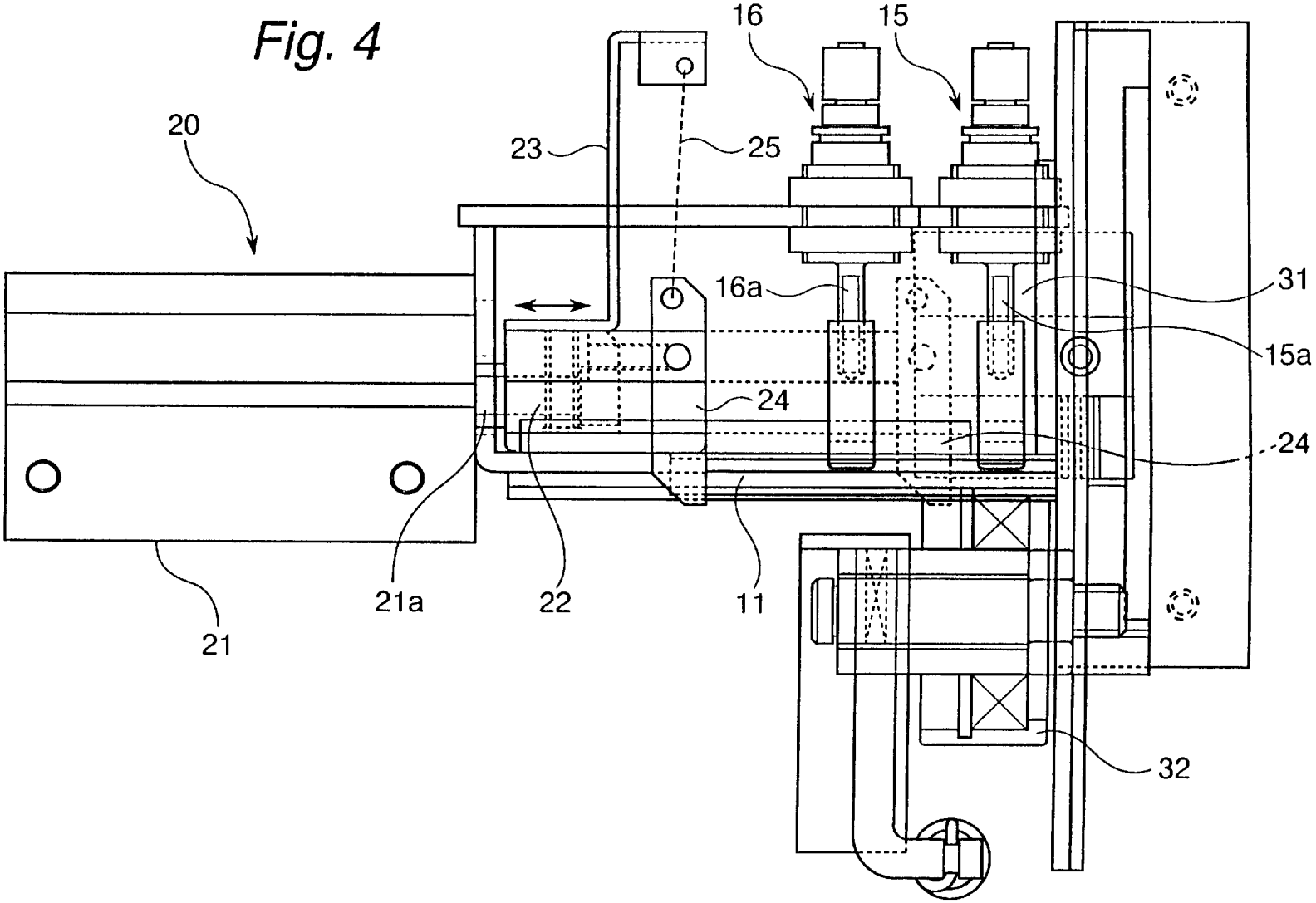
FIG. 4 is a side sectional view of the essential parts shown in FIG. 3.
Figure 8:
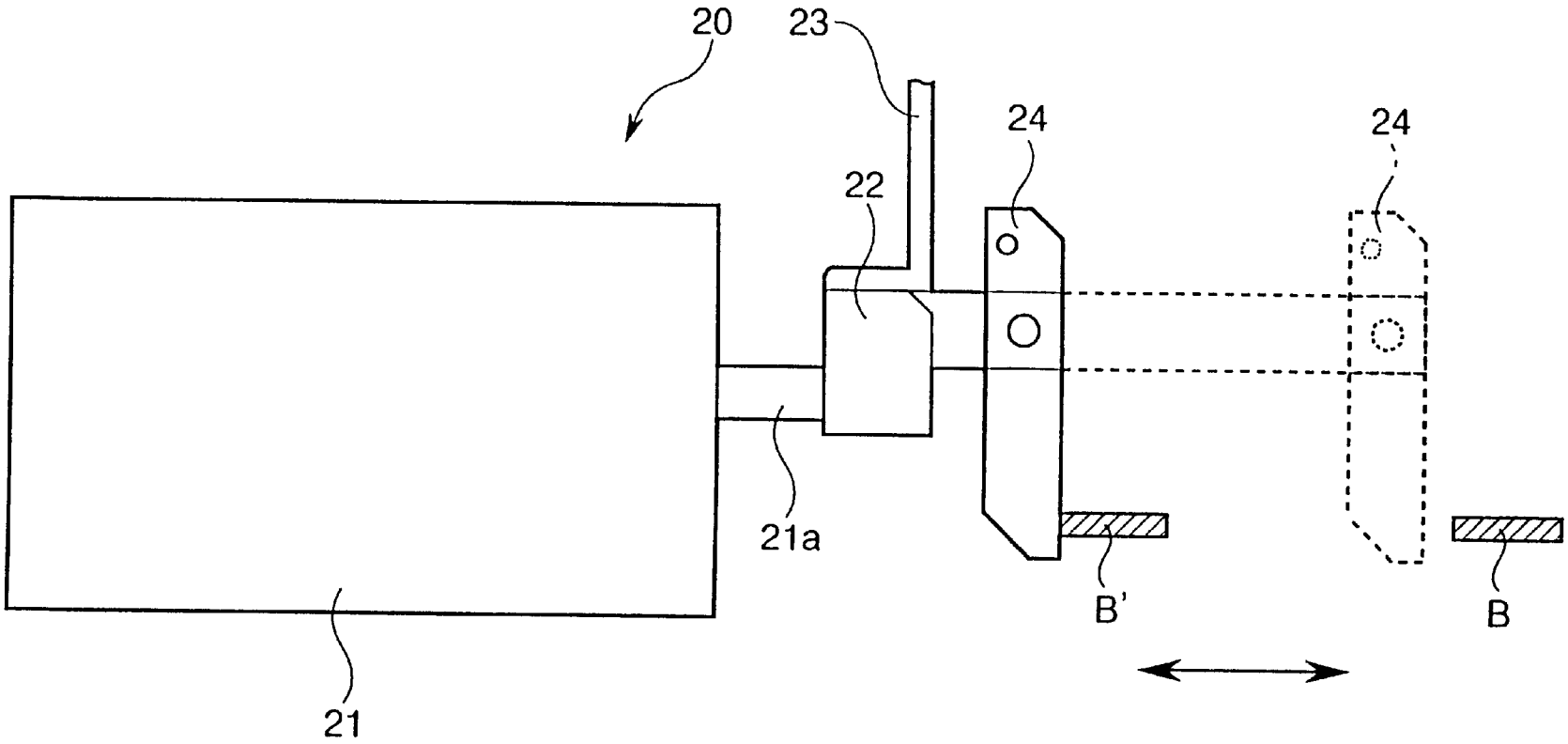
FIG. 8 is an explanatory view of a changeover unit employed in one embodiment of the present invention.

Referring to FIGS. 4 and 8, the band changeover unit 20 comprises cylinder 21, rod 21a, moving plate 22 which extends or contracts by means of the rod 21*a*. Furthermore, the band changeover unit 20 comprises L-shaped joint block 23 fitted to the moving plate 22, tilting piece 24 fitted to the moving plate 22 and spring 25 for controlling the position of the tilting piece 24.

The tilting piece 24 in waiting condition is interposed between the band in use B and the band B' set in stand-by condition, as indicated by broken line in FIG. 8, to thereby prevent the bands B,B' from contacting each other.

The tilting piece 24 can be moved from the position of the broken line to the position of the full line of FIG. 8 by the extension or contraction of the rod 21*a*. Further, the tilting piece 24, at given timing, is moved rightward from the full line position so that the band B or B' is guided to a position under the pool feed roller 31.

Forward and backward rotatable band feeding unit 30 is disposed downstream of the pin cylinders 15,16 in a manner such that the band guide 11 is passed therethrough.

The band feeding unit 30 comprises forward and backward rotatable pool feed roller 31 and touch roller 32. The touch roller 32 is supported by eccentric shaft 33, as shown in FIG. 9.

Figure 9:
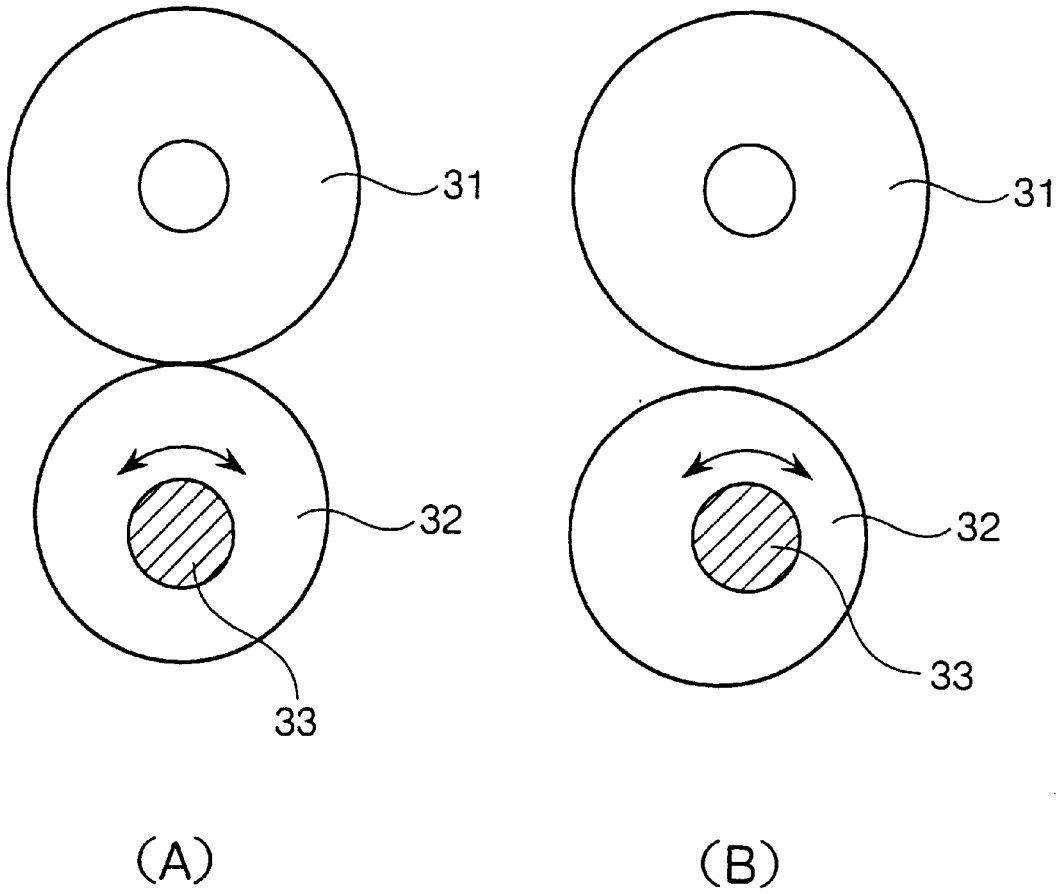
FIGS. 9(A) and 9(B) are explanatory views illustrating the function of a band feeding unit.
Figure 10:
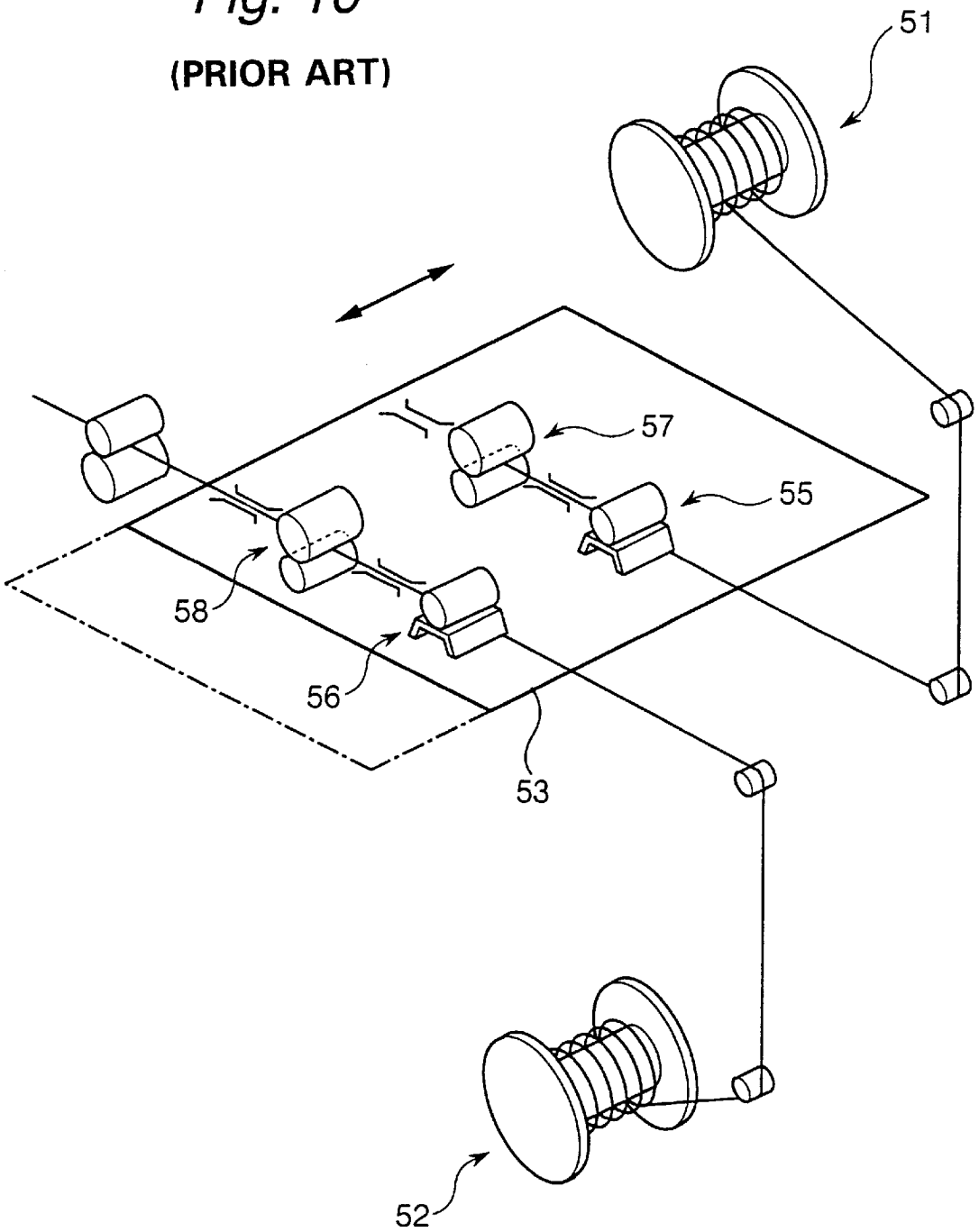
Fig. 10 (PRIOR ART)
FIG. 10 is a perspective view of essential parts of the conventional strapping packing machine.

Therefore, the touch roller 32 is set in a position either contacting the pool feed roller 31 as shown in FIG. 9(A) or parted from the pool feed roller 31 as shown in FIG. 9(B) in accordance with the rotational position thereof. Position changing unit 36 capable of changing the position of the touch roller 32 is disposed beside the touch roller 32. This position changing unit 36 is one for rotating the eccentric shaft 33 of the touch roller 32 so that the position of the touch roller 32 is changed. The position changing unit 36 comprises cylinder 37, rod 37*a*, L-shaped operating piece 38 pushed by the front end portion of the rod 37*a* and spring 41. The eccentric shaft 33 is rotated at a given angle by the extension of the rod 37*a* of the position changing unit 36. As a result, the touch roller 32 is parted from the pool feed roller 31, as shown in FIG. 9 (B). On the other hand, when the rod 37*a* is contracted, the touch roller 32 is brought into contact with the pool feed roller 31 by the action of spring 41, as shown in FIG. 9(A).

The constitution of the automatic band changing device of the present invention is as described above. Now, the operation of the automatic band changing device will be described.

At the start-up, one of the bands of the two band reels 1,2 is set in use condition while the other band is set in stand-by condition in the packing machine frame 10. The band from the first employed band reel 1 is fed through the pool shooter 12 and accommodated in the pool box (not shown) to thereby enable conducting customary strapping.

At that time, the front end portion of the spare band wound on the band reel 2 is fed on the guide roller 7 into the band changing port 13 and held down there by the pin 16*a* of the pin cylinder 16 so that it is set downward in stand-by condition.

From the above condition, the band B wound on the band reel 1 is continuously used in the strapping. When the quantity of available band is reduced and finally the rear end portion of the band in sheet form passes under the band end detecting roller 5 with the band depleted. Then, the depletion of the band is detected by the phototube sensor assembled in the band end detecting roller 5. Thereupon, the pin cylinder 15 is actuated by the command signal from the control unit, so that the pin 15*a* is moved downward. Thus, the final end portion of the band B in use is held down with the result that the moving of the band B is inhibited and, hence, the feeding of the band B is discontinued.

Subsequently, the pin 15*a* of the pin cylinder 15 is moved upward to the starting position, so that the final end of band in contact with the pin 15*a* is brought to a free state. Thereafter, the pool feed roller 31 is driven in reverse with the result that the remaining end portion of the band is passed through the gap between the pool feed roller 31 and the touch roller 32 and discharged from the device.

The discharge of the band is confirmed by the phototube 14. Thereupon, in accordance with the detection signal generated by the phototube 14, the pin 16*a* of the pin cylinder 16 is moved upward. Then, the tilting piece 24 of the band changeover unit 20, while oscillating counterclockwise, is moved leftward from the broken line position to the full line position of FIG. 4 and FIG. 8. Thereafter, the tilting piece 24 is again moved rightward so that the band B' set in stand-by condition under the pin cylinder 16 is pressed to the right side of FIGS. 4 and 8. This time, the band B' is set in use condition.

Thereafter, the pool feed roller 31 is rotated forward so that the band B' is fed into an arch to thereby enable subsequent strapping with the use of the band B'.

In the above manner, the other band reel can immediately be set upon the completion of the use of one band reel.

This automatic band changing device is so constructed that the band changeover unit 20 is driven to thereby guide the band of next use to specified site. Therefore, it is not needed to provide two sets of band feeding means, etc. in conformity with the number of band reels. As a result, the number of constituent parts can be reduced.

When the next band reel 2 is in use, the previously employed band reel 1 can be replaced by new one. Therefore, the replacement of the band reel can be performed during the continuous operation of strapping, so that the discontinuation of strapping operation by replacement time can be avoided.

One embodiment of the present invention has been described above. The present invention is not limited to the above embodiment, however, and various modifications can be made on the basis of the technical teachings of the present invention.

For example, although the use of two band reels has been described in the above embodiment, an arrangement can be made such that more, for example, three band reels are alternately used.

As apparent from the foregoing, the replacement of the band can be conducted by the use of band changeover lever in the automatic band changing device of the present invention. Therefore, the structure of the device is simple and the number of constituent parts can be small. Moreover, no use is made of a member which moves in the horizontal direction. This is advantageous from the viewpoint of the contribution to the miniaturization of the strapping packing machine.

What is claimed is:

1. An automatic band changing device for a strapping packing machine, comprising:

a band guide for guiding front end portions of respective bands drawn out from two band reels in substantially parallel relationship, wherein one band is in use and the other band is a stand-by band, a cylindrical guide roller for feeding a band from a band changing port to the band guide, wherein the cylindrical guide roller has a rotatable part on which the band in use is disposed and an adjacent non-rotatable part on which the stand-by band is disposed, a sensor arranged so as to face the band guide and capable of detecting a rear end portion of band in use, two pin cylinder units capable of actuating a pin for holding down the rear end portion of band in use in accordance with a detection signal from the sensor and a pin for releasing a front end portion of the stand-by band having been held down and not in use, a band feeding unit composed of a forward and backward rotatable pool feed roller and a touch roller fitted with an eccentric shaft, these arranged opposite to each other so as to have a traveling passage of the band guide interposed therebetween, a cylinder unit fitted to the touch roller and capable of bringing the touch roller into contact with the forward rotating pool feed roller or parting the touch roller from the forward rotating pool feed roller, and a band changeover lever arranged beside the band guide and capable of moving a front end portion of stand-by band to a band passage of the band guide when one of the band reels becomes empty.

2. The automatic band changing device as claimed in claim 1, wherein the cylindrical guide roller for feeding the band from the band changing port to the band guide is partitioned into two parts, one portion is fixed and unable to rotate and one portion is rotatable on a bearing, these having a level difference exhibited therebetween.

* * * * *

UNITED STATES PATENT AND TRADEMARK OFFICE

CERTIFICATE OF CORRECTION

PATENT NO. : 6,086,011
DATED : July 11, 2000
INVENTOR(S) : Tokio Shibazaki et al.

It is certified that error appears in the above-identified patent and that said Letters Patent is hereby corrected as shown below:

Title Page, in the Title [54] "CHARGING" should read --CHANGING--.

Title Page, under [56] References Cited, U.S. PATENT DOCUMENTS, next-to-last reference in column 2, "Shuttler" should read --Schuttler--.

Signed and Sealed this

Seventh Day of August, 2001

*Attest:*

Nicholas P. Godici

*Attesting Officer*

NICHOLAS P. GODICI
*Acting Director of the United States Patent and Trademark Office*